US008248317B1

(12) United States Patent
Meagher et al.

(10) Patent No.: US 8,248,317 B1
(45) Date of Patent: Aug. 21, 2012

(54) SYSTEM FOR PHYSICAL SIMULATION OF LONG-DISTANCE AND DIRECTIONAL WIRELESS CHANNELS

(75) Inventors: Christopher J. Meagher, San Diego, CA (US); Randall B. Olsen, Carlsbad, CA (US); Christopher C Cirullo, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 778 days.

(21) Appl. No.: 12/435,936

(22) Filed: May 5, 2009

(51) Int. Cl.
*H01Q 19/06* (2006.01)

(52) U.S. Cl. ..... 343/754; 343/753; 343/853

(58) Field of Classification Search ..... 343/753, 343/754, 853, 909; 342/368, 371–374
See application file for complete search history.

(56) References Cited

U.S. PATENT DOCUMENTS 3,761,936 A * 9/1973 Archer et al. ..... 343/754
4,121,221 A * 10/1978 Meadows ..... 342/374
4,176,322 A 11/1979 Kommrusch
4,348,678 A * 9/1982 Thomas ..... 343/754
4,490,723 A * 12/1984 Hardie et al. ..... 343/754
4,558,324 A * 12/1985 Clapp ..... 343/754
4,845,507 A * 7/1989 Archer et al. ..... 343/754
7,075,893 B1 7/2006 Mlinarsky et al.
7,136,587 B1 11/2006 Davis et al.

* cited by examiner

*Primary Examiner* — Hoang V Nguyen
(74) *Attorney, Agent, or Firm* — Ryan J. Friedl; Kyle Eppele

(57) ABSTRACT

A system includes a first radio frequency (RF) lens having array ports and beam ports, and a second RF lens having array ports and beam ports. At least two of the second RF lens array ports are connected to at least two of the first RF lens array ports by phase-matched connectors. The RF lenses may be continuously steerable RF lenses, Rotman lenses, or discretely steerable RF lenses. The system may include first, second, third, and fourth RF switches, at least one transmitter with an associated controller, at least one receiver with associated controller, and an environment controller. The system may also include long-distance simulators connected between the RF switches of the directional simulator and the receiver or the transmitter and controlled by an environment controller. Other system embodiments include multi-pair RF lenses, as well as an RF lens connected to an antenna array system.

18 Claims, 7 Drawing Sheets

SYSTEM FOR PHYSICAL SIMULATION OF LONG-DISTANCE AND DIRECTIONAL WIRELESS CHANNELS

FEDERALLY SPONSORED RESEARCH AND DEVELOPMENT

The System for Physical Simulation of Long-Distance and Directional Wireless Channels is assigned to the United States Government and is available for licensing for commercial purposes. Licensing and technical inquiries may be directed to the Office of Research and Technical Applications, Space and Naval Warfare Systems Center, Pacific, Code 2112, San Diego, Calif., 92152; voice (619) 553-2778; email T2@spawar.navy.mil. Reference Navy Case No. 99574.

BACKGROUND

Military communications typically require long distance, low latency, and high reliability links. There is interest in leveraging commercial off-the shelf (COTS) wireless technology to bolster military communication capabilities. However, COTS radios are typically designed for home, school, or office use, requiring that either the COTS radios be modified, or specific architectures be designed for particular military applications.

It is important to test a chosen radio or communication architecture for functionality within its intended operational environment. For proof-of-concept and prototyping, purely software-based simulation can be helpful. However, drawbacks to the software-only approach to simulation include high costs, limited hardware-in-the-loop options, and steep learning curves for use of the software. On the other hand, solely using hardware in a near-operational environment is prohibitively expensive for proof-of-concept and development testing.

A need exists for a system that lies within the middle ground between software-only simulation and operational environment hardware testing.

DETAILED DESCRIPTION OF SOME EMBODIMENTS

Figure 1:
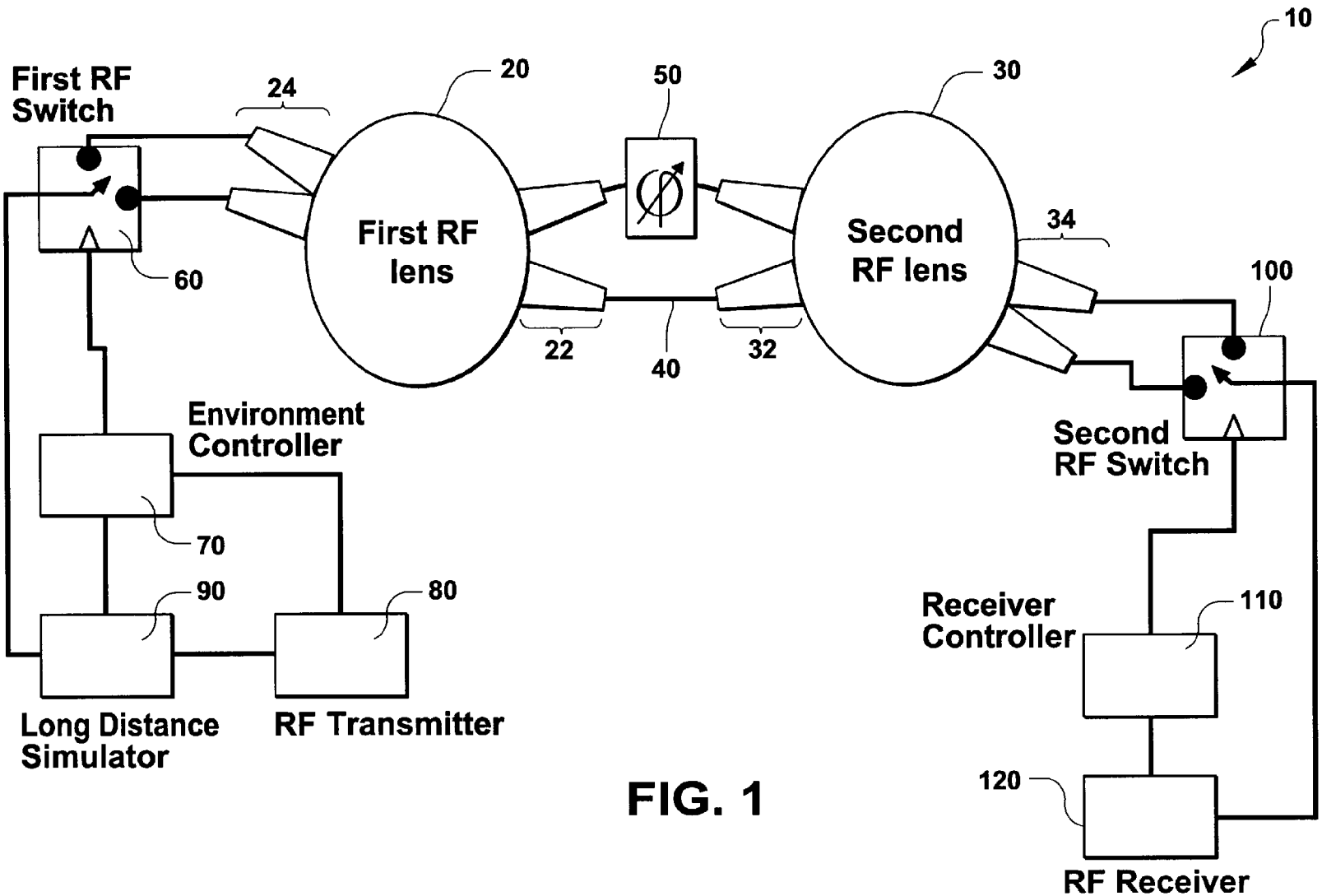
FIG. 1 shows a diagram of an embodiment of a single-pair lens system in accordance with the System for Physical Simulation of Long-Distance and Directional Wireless Channels.

FIG. 1 shows a diagram of an embodiment of a single-pair lens system 10 in accordance with the System for Physical Simulation of Long-Distance and Directional Wireless Channels. System 10 may include a first radio frequency (RF) lens 20 and a second RF lens 30. RF lenses provide a compact way to simulate propagation of directional beams. First RF lens 20 includes at least two first RF lens array ports 22 and at least one first RF lens beam port 24. Second RF lens 30 includes at least two second RF lens array ports 32 and at least one second RF lens beam port 34. First RF lens 20 and second RF lens 30 may be Rotman lenses. In some embodiments, first RF lens 20 and second RF lens 30 may be discretely-steerable RF lenses with at least two first RF lens beam ports 24 and at least two second RF lens beam ports 34. In some embodiments, first RF lens 20 and second RF lens 30 may be contained on a printed circuit board.

At least two of second RF lens array ports 32 are connected to at least two of first RF lens array ports 22 by phase-matched connectors 40. As an example, phase-matched connectors 40 may be nested cosine wires. In other embodiments, phase-matched connectors 40 may be discrete coaxial cables or waveguides designed and tested to provide the same total phase shift. Such a configuration of RF lenses 20 and 30 may be referred to as a "back-to-back" configuration. By connecting RF lenses 20 and 30 in a back-to-back configuration, one-dimensional transmit and receive beam steering can be simulated. RF lenses 20 and 30 can each independently generate a phase slope $\phi_n$ that, if feeding a linear array antenna, would create a beam at some angle, $\theta_s$, where:

$$\theta_s = \sin^{-1}\left(\frac{\varphi_n \lambda}{2\pi n \Delta_x}\right) \quad \text{(Eq. 1)}$$

where $\lambda$ is the wavelength, n is the number of elements, and $\Delta_x$ is the inter-element spacing. By reciprocity, the same beam impinging upon a linear array antenna would generate a phase slope of $\phi_n$. By connecting first RF lens 20 and second RF lens 30 together with phase-matched connectors 40, free space propagation between the lenses can be avoided.

System 10 may further include one or more phase-shifter 50 connected between at least one first RF lens array port 22 and at least one second RF lens array port 32. Phase-shifter 50 may be configured to more finely steer the beam in the case of using discretely-steerable RF lenses or to introduce further beam shaping regardless of the type of RF lenses used. An example of further beam shaping may be null-steering.

System 10 may also include a first RF switch 60, environment controller 70, RF transmitter 80, long-distance simulator 90, second RF switch 100, receiver controller 110, and RF receiver 120. First RF switch 60 may be connected to at least two beam ports 24 of first RF lens 20. As an example, first RF switch 60 may be a single pole, double throw GaAs RF switch, such as switch HMC270MS8G manufactured by the Hittite Microwave Corporation.

Environment controller 70 is connected to the control line (s) of first RF switch 60, RF transmitter 80, and long-distance simulator 90. Environment controller 70 may comprise a general purpose computing device having software installed therein that controls the throw selection of first RF switch 60 and the distance selection of the long-distance simulator 90. The environment controller may steer one RF lens to simulate changing the position of the remote node or a rotation of the local node. Then, the system under test (SUT, for example, the receiver controller 110) sweeps across the beams on its RF lens to choose the best pointing direction.

An example of an RF transmitter 80 is an HP 8673D Synthesized Signal Generator manufactured by the Agilent Corporation. Another example is the voltage controlled oscillator HMC431LP4 manufactured by the Hittite Microwave Corporation.

Long-distance simulator 90 is connected to environment controller 70, RF transmitter 80, and first RF switch 60. Long-distance simulator 90 is discussed in more detail with reference to FIGS. 3 and 4 herein.

Second RF switch 100 may be connected to at least two beam ports 34 of second RF lens 30. Second RF switch 100 may be configured the same as or similar to first RF switch 60. Receiver controller 110 is connected to the control line(s) of second RF switch 100 and to RF receiver 120. RF receiver 120 is connected to receiver controller 110 and to the common/pole port of second RF switch 100. An example of an RF receiver 120 suitable for use within system 10 is the HP 8566B Spectrum Analyzer manufactured by the Agilent Corporation. Alternatively, wireless radios or other transceivers can be used in place of RF receiver 120 and RF transmitter 80. An example of a wireless radio suitable for use in place of RF receiver 120 and RF transmitter 80 is the Xtreme Range 5 radio manufactured by the Ubiquiti Networks Corporation.

Figure 2:
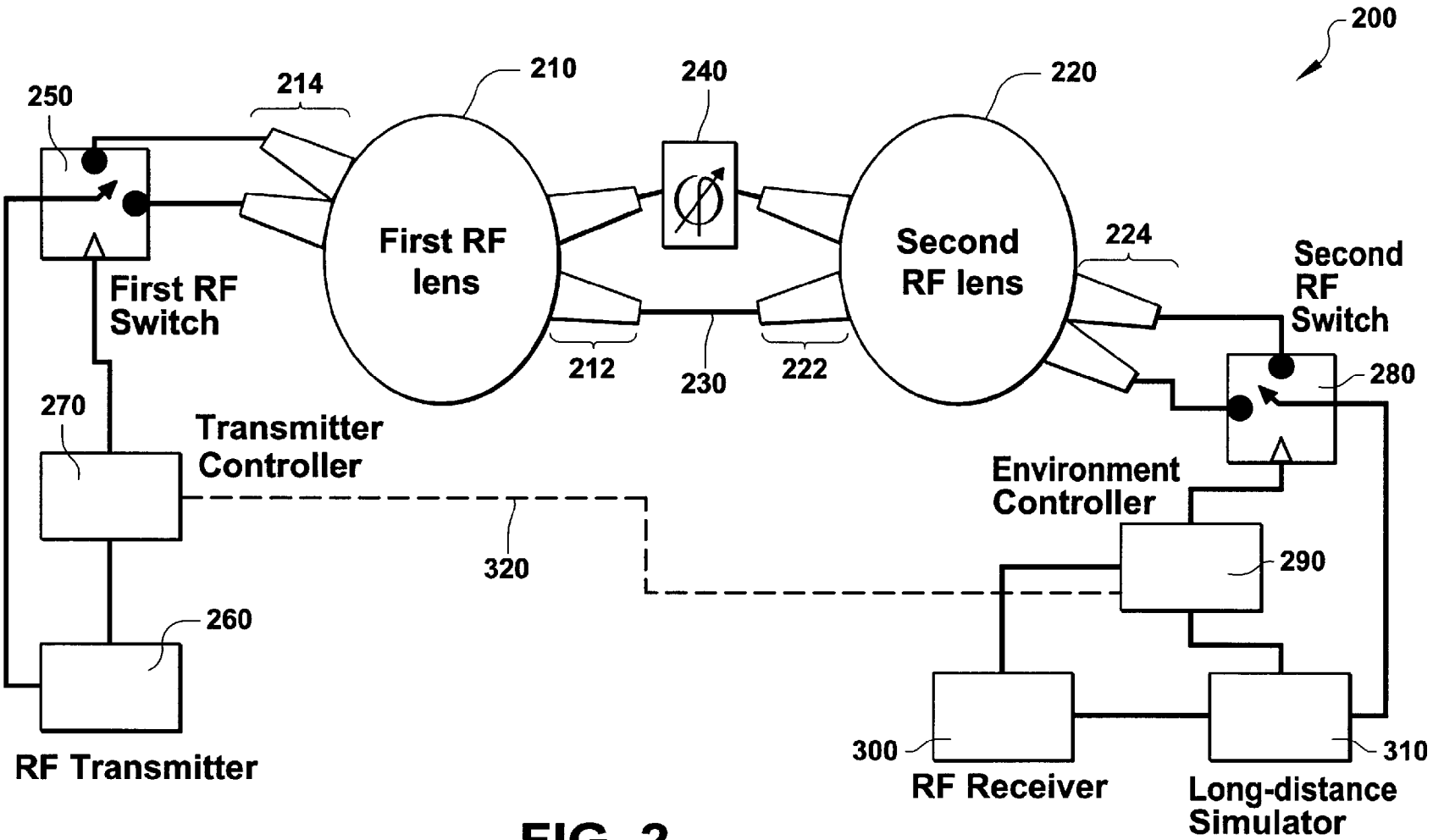
FIG. 2 shows a diagram of another embodiment of a single-pair lens system in accordance with the System for Physical Simulation of Long-Distance and Directional Wireless Channels.

FIG. 2 shows a diagram of another embodiment of a single-pair lens system 200 in accordance with the System for Physical Simulation of Long-Distance and Directional Wireless Channels. Components of system 200 having the same names as components of system 10 may be configured the same as such components of system 10. System 200 may include a first RF lens 210, second RF lens 220, phase-matched connectors 230, and one or more phase-shifter 240. First RF lens 210 may contain first RF lens array ports 212 and first RF lens beam ports 214. Second RF lens 220 may contain second RF lens array ports 222 and second RF lens beam ports 224. System 200 may further include a first RF switch 250, RF transmitter 260, transmitter controller 270, second RF switch 280, environment controller 290, RF receiver 300, and long-distance simulator 310.

The configuration of system 200 is the reciprocal of system 10 and may be used, as an example, to simulate and test transmit-only systems that need to find or track their target spatially and over long distances. The feedback of receiver information such as bit error rate, signal strength, or average RF power, may be fed to transmit controller 270 via an out-of-band feedback line 320. Feedback line 320 may simulate out-of-band feedback to transmitter 260, visual verification of target acquisition, or similar feedback mechanisms that are not sent on the same directional, long-distance wireless channel being simulated.

Figure 3:
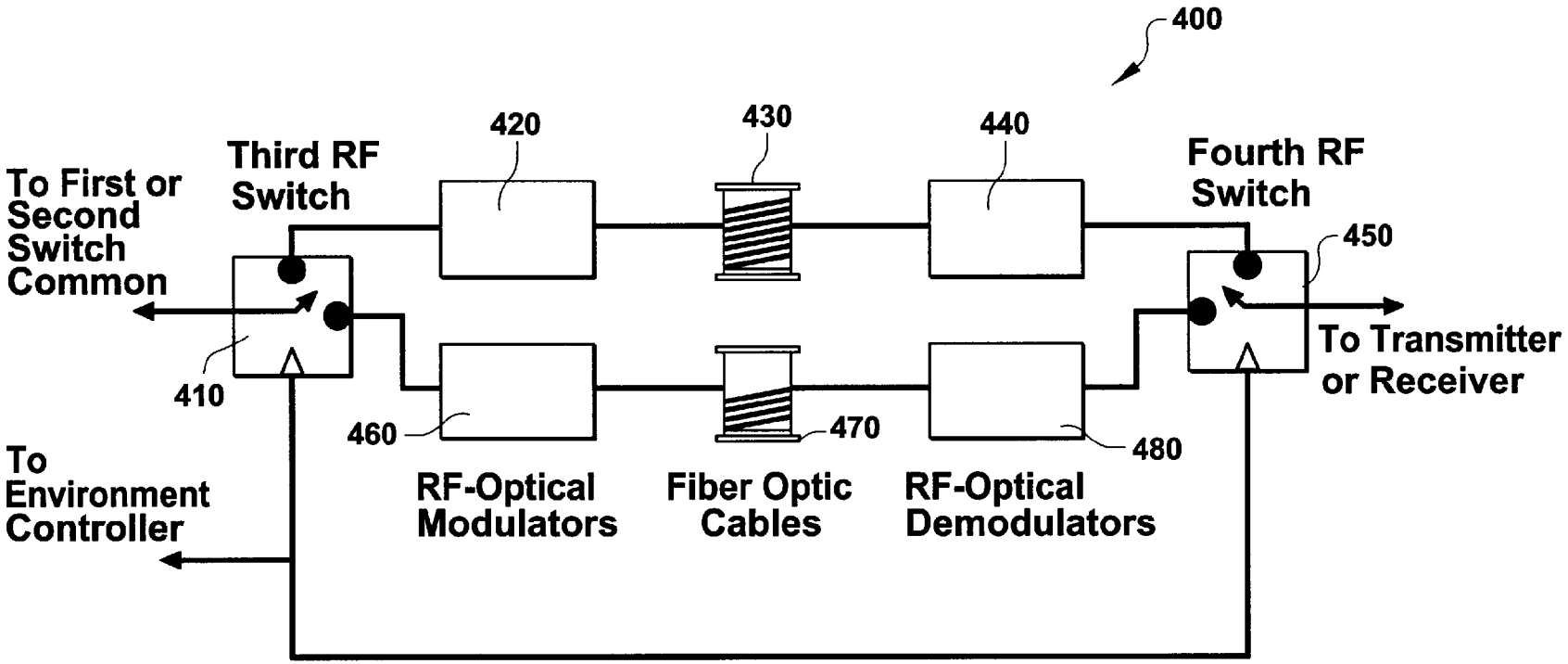
FIG. 3 shows a diagram of an embodiment of a long-distance simulator system in accordance with the System for Physical Simulation of Long-Distance and Directional Wireless Channels.

FIG. 3 shows a diagram of an embodiment of a long-distance simulator system 400 in accordance with the System for Physical Simulation of Long-Distance and Directional Wireless Channels. System 400 may include a third RF switch 410, RF optical modulators 420 and 460, fiber-optic cables 430 and 470, RF optical demodulators 440 and 480, and fourth RF switch 450. Fiber-optic cables 430 and 470 may be varying lengths depending on the particular system to be tested. As an example, fiber optic cable 430 may be 10,000 feet in length, and fiber optic cable 470 may be 500 feet in length, for a particular application testing 802.11 acknowledgement timeout settings and network latency resulting from propagation delays.

System 400 may be incorporated into either system 10 or 200 as described herein. As an example, if system 400 is incorporated into system 10, system 400 would replace long-distance simulator 90. In such a scenario, third RF switch 410 may be connected to first RF switch 60 and fourth RF switch 450 may be connected to RF transmitter 80. Further, the control line(s) of both third RF switch 410 and fourth RF switch 450 may be connected to environment controller 70. As another example, if system 400 is incorporated into system 200, system 400 would replace long-distance simulator 310. In such a scenario, third RF switch 410 may be connected to second RF switch 280 and fourth RF switch 450 may be connected to RF receiver 300. Further, the control line(s) of both third RF switch 410 and fourth RF switch 450 may be connected to environment controller 290.

In operation, a signal entering third RF switch 410 may be routed through a first path comprising RF optical modulator 420, fiber-optic cable 430, RF-optical demodulator 440, and fourth RF switch 450. Alternatively, a signal entering third RF switch 410 may be routed through a second path comprising RF optical modulator 460, fiber-optic cable 470, RF-optical demodulator 480, and fourth RF switch 450. The signal may be routed through the first path or second path depending upon the distance or propagation delay desired and chosen by the environment controller. Switch 450 outputs the signal to either RF transmitter 80 or RF receiver 300, depending upon the system configuration.

Figure 4:
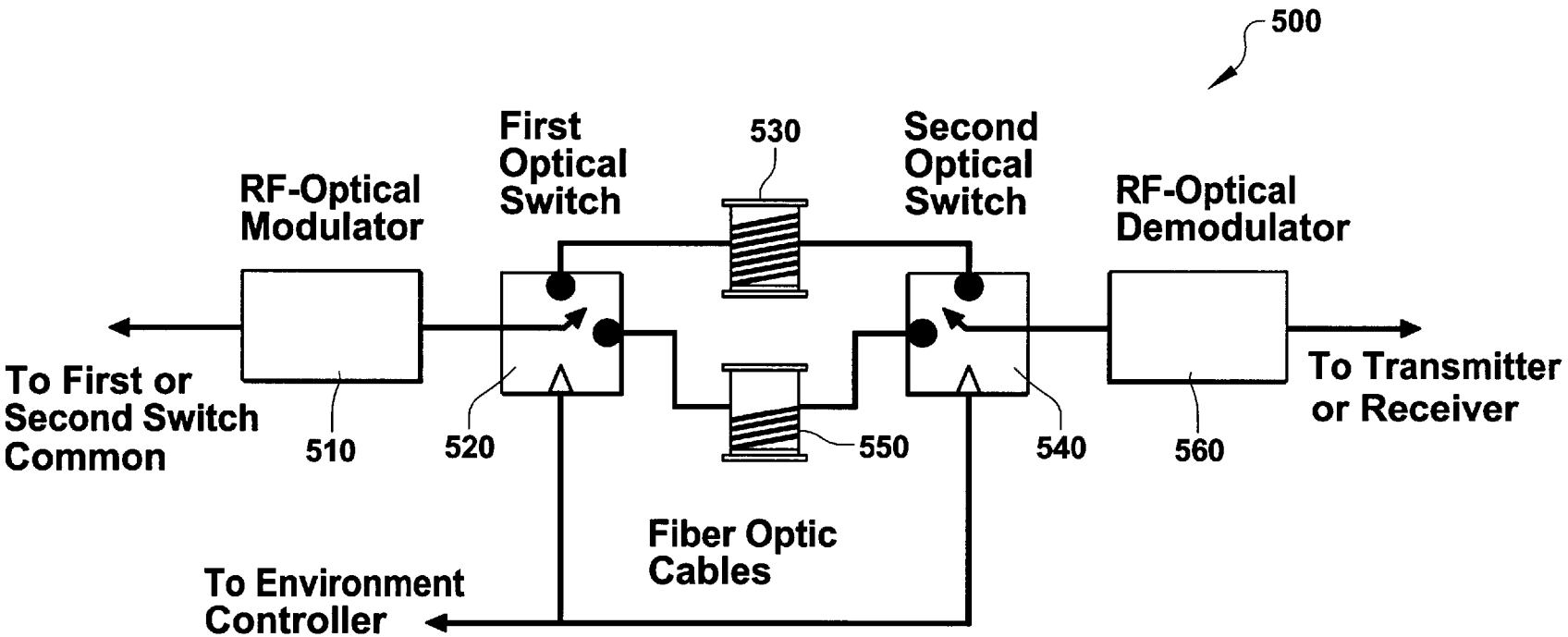
FIG. 4 shows a diagram of another embodiment of a long-distance simulator system in accordance with the System for Physical Simulation of Long-Distance and Directional Wireless Channels.

FIG. 4 shows a diagram of another embodiment of a long-distance simulator system 500 in accordance with the System for Physical Simulation of Long-Distance and Directional Wireless Channels. System 500 may include an RF optical modulator 510, a first optical switch 520, fiber-optic cables 530 and 550, second optical switch 540, and RF optical demodulator 560. Fiber-optic cables 530 and 550 may be varying lengths depending on the particular system to be tested.

System 500 may be incorporated into either system 10 or 200 as described herein. As an example, if system 500 is incorporated into system 10, system 500 would replace long-distance simulator 90. In such a scenario, RF optical demodulator 560 may be connected to RF transmitter 80 and RF optical modulator 510 may be connected to first RF switch 60. Further, the control line(s) of both first optical switch 520 and second optical switch 540 may be connected to environment controller 70. As another example, if system 500 is incorporated into system 200, system 500 would replace long-distance simulator 310. In such a scenario, RF optical modulator 510 may be connected to second RF switch 280 and RF optical demodulator 560 may be connected to RF receiver 300. Further, the control lines of both first optical switch 520 and second optical switch 540 may be connected to environment controller 290.

In operation, a signal entering RF optical modulator 510 may be output to first optical switch 520. The signal may then be either routed through fiber optic cable 530 or fiber optic cable 550, from either of which the signal is output to second optical switch 540. Second optical switch 540 outputs the signal to RF optical demodulator 560, which outputs the signal to either RF transmitter 80 or RF receiver 300, depending upon the system configuration.

Figure 5:
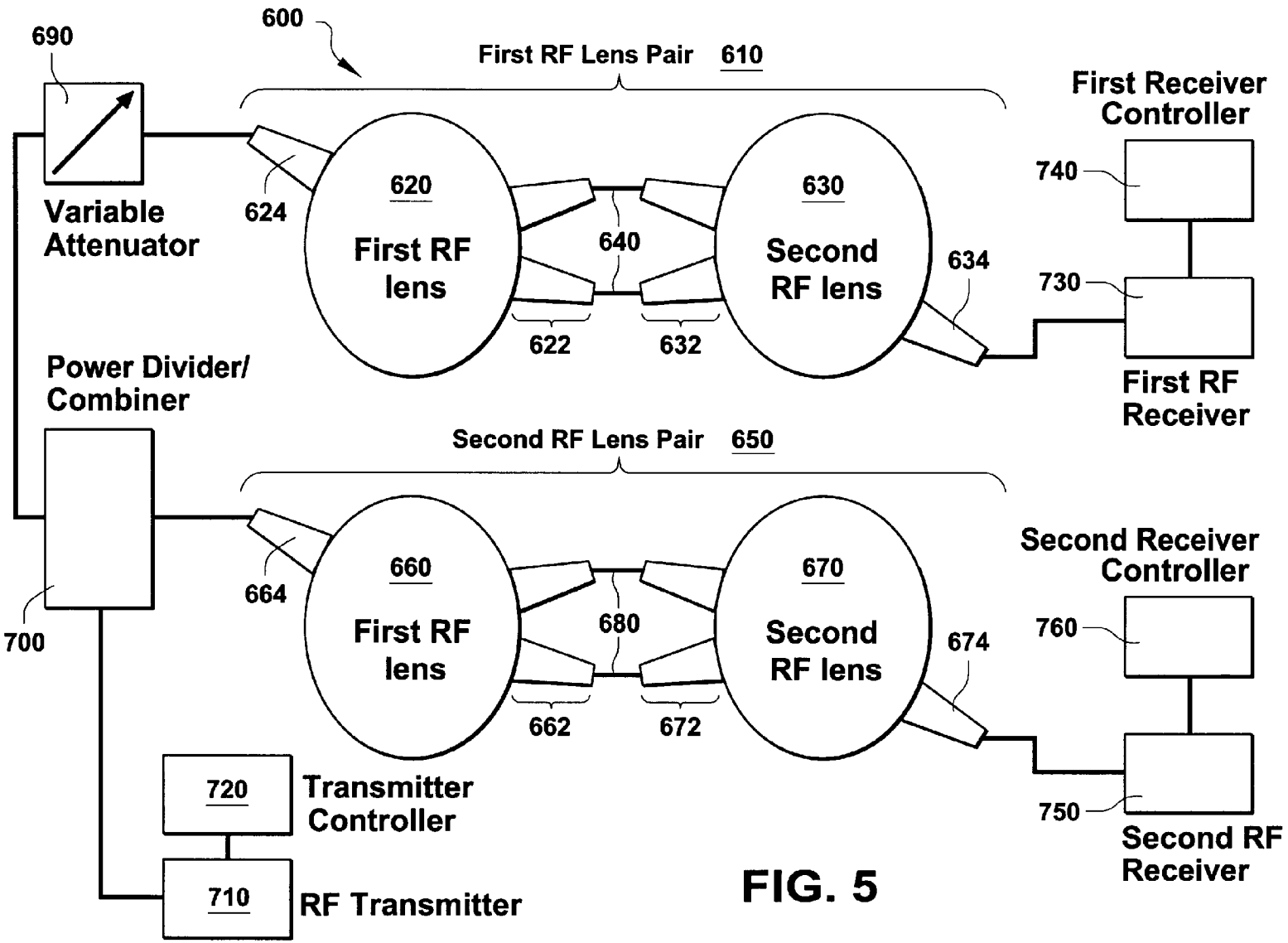
FIG. 5 shows a diagram of an embodiment of a multi-pair lens system in accordance with the System for Physical Simulation of Long-Distance and Directional Wireless Channels.

FIG. 5 shows a diagram of an embodiment of a multi-pair lens system 600 in accordance with the System for Physical Simulation of Long-Distance and Directional Wireless Channels. System 600 may include a first RF lens pair 610 and a second RF lens pair 650. First RF lens pair 610 may include a first RF lens 620 having at least two first RF lens array ports 622 and at least one first RF lens beam port 624, and a second RF lens 630 having at least two second RF lens array ports 632 and at least one second RF lens beam port 634. At least two of second RF lens array ports 632 are connected to at least two of the first RF lens array ports 622 by phase-matched connectors 640. In some embodiments, phase-matched connectors 640 are nested cosine wires. System 600 may further include a variable attenuator 690 connected to first RF lens pair 610, via first RF lens beam port 624, and a first branch of a power divider/combiner 700.

Second RF lens pair 650 may include a first RF lens 660 having at least two first RF lens array ports 662 and at least one first RF lens beam port 664, and a second RF lens 670 having at least two second RF lens array ports 672 and at least one second RF lens beam port 674. At least two of second RF lens array ports 672 are connected to at least two of the first RF lens array ports 662 by phase-matched connectors 680. In some embodiments, phase-matched connectors 680 are nested cosine wires. Second RF lens pair 650 may be connected to a second branch of power divider/combiner 700 via, as an example, first RF lens beam port 664.

System 600 may further comprise an RF transmitter 710 connected to the common port of power divider/combiner 700, as well as an environment controller 720 connected to RF transmitter 710. RF transmitter 710 may be configured similarly to RF transmitter 80 of FIG. 1, while environment controller 720 may be configured similarly to environment controller 70.

System 600 may further include a first RF receiver 730 connected to second RF lens beam port 634, as well as a first receiver controller 740 connected to first RF receiver 730. System 600 may also include a second RF receiver 750 connected to second RF lens beam port 674, as well as a second receiver controller 760 connected to second RF receiver 750. First RF receiver 730 and second RF receiver 750 may be configured similarly to RF receiver 120 of FIG. 1. First receiver controller 740 and second receiver controller 760 may be configured similarly to receiver controller 110.

The configuration of system 600 enables the physical simulation of directional wireless systems operating over wider spatial angles than are possible through use of a single back-to-back RF lens pair. RF lenses are typically limited to at most +/−60° scanning. Use of multiple back-to-back RF lens pairs in system 600 allows each lens pair to cover different sectors of the total angular space. Steering continuity between sectors is simulated by having the same signals through each lens pair, through use of power divider/combiner 700, and affecting the attenuation of one branch relative to the other through use of variable attenuator 690. An example use would be to test handover between sectors of a cellular base station.

Figure 6:
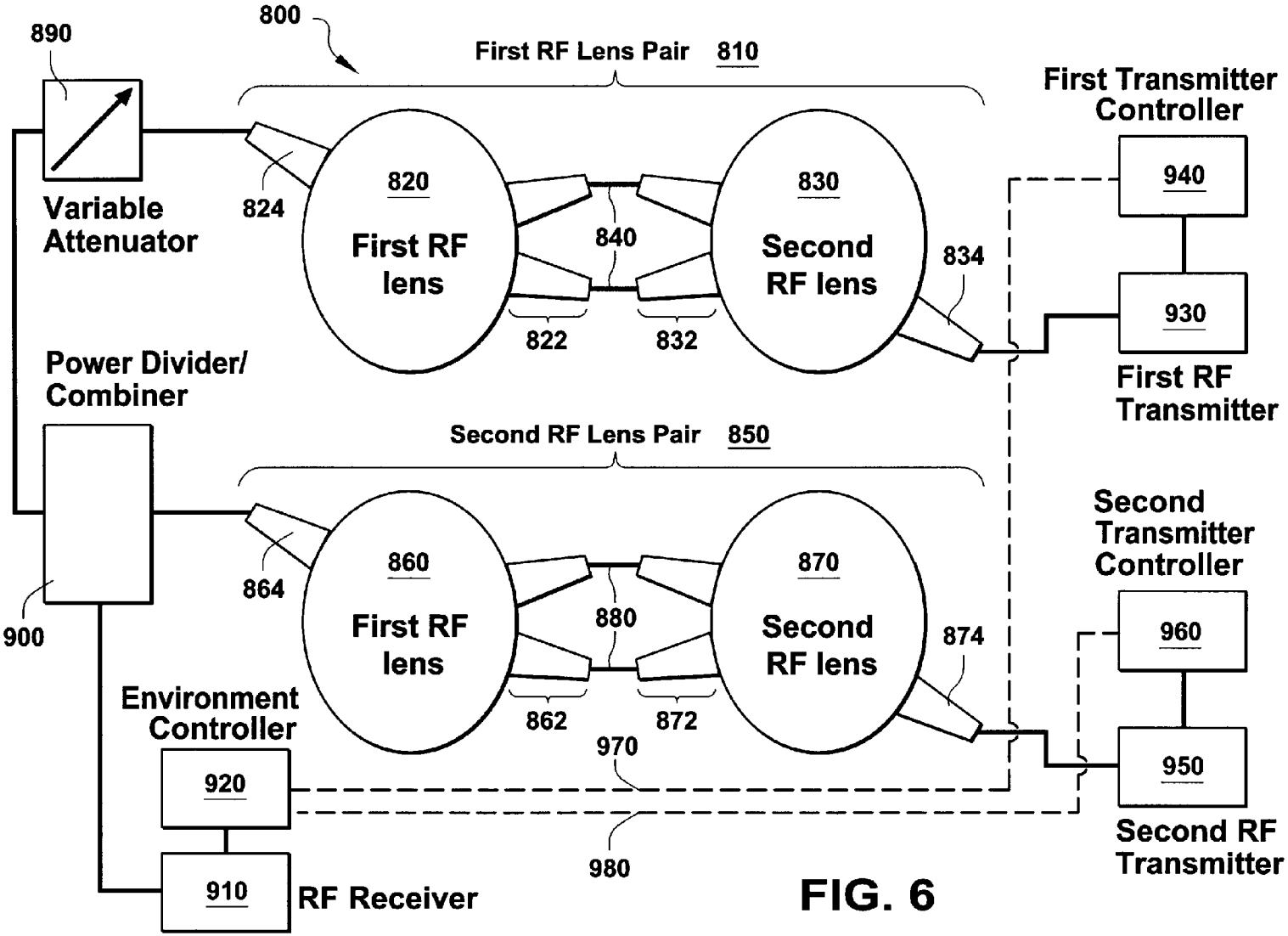
FIG. 6 shows a diagram of another embodiment of a multi-pair lens system in accordance with the System for Physical Simulation of Long-Distance and Directional Wireless Channels.

FIG. 6 shows a diagram of another embodiment of a multi-pair lens system 800 in accordance with the System for Physical Simulation of Long-Distance and Directional Wireless Channels. System 800 may include a first RF lens pair 810 and a second RF lens pair 850. First RF lens pair 810 may include a first RF lens 820 having at least two first RF lens array ports 822 and at least one first RF lens beam port 824, and a second RF lens 830 having at least two second RF lens array ports 832 and at least one second RF lens beam port 834. At least two of second RF lens array ports 832 are connected to at least two of the first RF lens array ports 822 by phase-matched connectors 840. In some embodiments, phase-matched connectors 840 are nested cosine wires. System 800 may further include a variable attenuator 890 connected to first RF lens pair 810, via first RF lens beam port 824, and a first branch of a power divider/combiner 900.

Second RF lens pair 850 may include a first RF lens 860 having at least two first RF lens array ports 862 and at least one first RF lens beam port 864, and a second RF lens 870 having at least two second RF lens array ports 872 and at least one second RF lens beam port 874. At least two of second RF lens array ports 872 are connected to at least two of the first RF lens array ports 862 by phase-matched connectors 880. In some embodiments, phase-matched connectors 880 are nested cosine wires. Second RF lens pair 850 may be connected to a second branch of power divider/combiner 900 via, as an example, first RF lens beam port 864.

System 800 may further comprise an RF receiver 910 connected to the common port of power divider/combiner 900, as well as an environment controller 920 connected to RF receiver 910. RF receiver 910 may be configured similarly to RF receiver 300 of FIG. 2, while environment controller 920 may be configured similarly to environment controller 290.

System 800 may further include a first RF transmitter 930 connected to second RF lens beam port 834, as well as a first transmitter controller 940 connected to first RF transmitter 930. System 800 may also include a second RF transmitter 950 connected to second RF lens beam port 874, as well as a second transmitter controller 960 connected to second RF transmitter 950. First RF transmitter 930 and second RF transmitter 950 may be configured similarly to RF transmitter 260 of FIG. 2. First transmitter controller 940 and second transmitter controller 960 may be configured similarly to transmitter controller 270. The configuration of system 800 is the reciprocal of system 600 and enables simulation of similar scenarios.

The feedback of receiver information such as bit error rate, signal strength, or average RF power, may be fed to first transmit controller 940 via an out-of-band feedback line 970, and to second transmitter controller 960 via out-of-band feedback line 980. Feedback lines 970 and 980 may simulate out-of-band feedback to first transmitter 930 and second transmitter 950, respectively, visual verification of target acquisition, or similar feedback mechanisms that are not sent on the same directional, long-distance wireless channel being simulated. Feedback lines 970 and 980 may be configured similarly to feedback line 320 of system 200.

Figure 7:
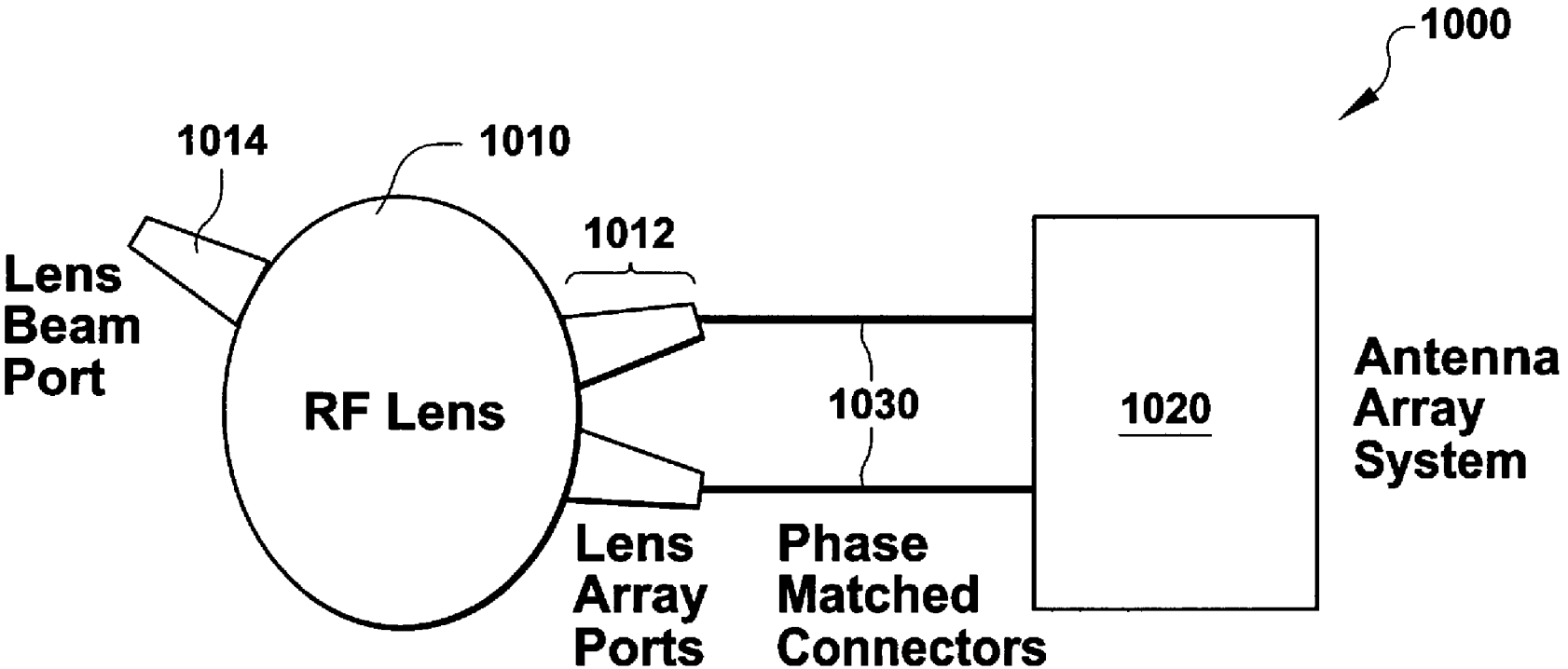
FIG. 7 shows a diagram of an embodiment of a lens system in accordance with the System for Physical Simulation of Long-Distance and Directional Wireless Channels.

FIG. 7 shows a diagram of an embodiment of a lens system 1000 in accordance with the System for Physical Simulation of Long-Distance and Directional Wireless Channels. System 1000 may include an RF lens 1010 having at least two lens array ports 1012 and at least one lens beam port 1014. RF lens 1010 may be connected to antenna array system 1020 by phase-matched connectors 1030. In some embodiments, antenna array system 1020 contains a plurality of antenna ports, wherein RF lens 1010 is connected to antenna array system 1020 via the antenna ports. System 1000 may be used to test directional wireless systems that have already integrated an antenna array front-end. Examples of such systems may be multiple input multiple output (MIMO) communications systems and phased array RADAR systems. By connecting the antenna ports of antenna array system 1020 to the array ports of RF lens 1010 via phase-matched connectors 1030, over-the-air radiation is avoided while RF lens 1010 produces phase slopes that simulate directional beam pointing.

Many modifications and variations of the System for Physical Simulation of Long-Distance and Directional Wireless Channels are possible in light of the above description. Within the scope of the appended claims, the System for Physical Simulation of Long-Distance and Directional Wireless Channels may be practiced otherwise than as specifically described. Further, the scope of the claims is not limited to the implementations and embodiments disclosed herein, but extends to other implementations and embodiments as may be contemplated by those having ordinary skill in the art.

We claim:

1. A system comprising:

a first radio frequency (RF) lens having at least two first RF lens array ports and at least one first RF lens beam port; and a second RF lens having at least two second RF lens array ports and at least one second RF lens beam port, wherein at least two of the second RF lens array ports are connected to at least two of the first RF lens array ports by phase-matched connectors.

2. The system of claim 1, wherein the first RF lens and the second RF lens are Rotman lenses.

3. The system of claim 1, wherein at least one of the first RF lens and the second RF lens are contained on a printed circuit board.

4. The system of claim 1 further comprising at least one phase-shifter connected between the first RF lens array ports and the second RF lens array ports.

5. The system of claim 1, wherein the first RF lens and the second RF lens are discretely-steerable RF lenses with at least two first RF lens beam ports and at least two second RF lens beam ports.

6. The system of claim 5 further comprising a first RF switch connected to at least two first RF lens beam ports and a second RF switch connected to at least two second RF lens beam ports.

7. The system of claim 6 further comprising:

an RF transmitter connected to the first RF switch; and an RF transmitter controller connected to the RF transmitter and the first RF switch.

8. The system of claim 7 further comprising:

an RF receiver connected to the second RF switch; and an RF receiver controller connected to the RF receiver and the second RF switch.

9. The system of claim 8 further comprising a long-distance simulator connected between the RF receiver and the second RF switch.

10. The system of claim 9, wherein the long-distance simulator comprises:

a third RF switch connected to the second RF switch;

at least two RF-optical modulators connected to the third RF switch;

a fiber-optic cable connected to each of the RF-optical modulators;

an RF-optical demodulator connected to each of the fiber-optic cables; and a fourth RF switch connected to the RF-optical demodulators.

11. The system of claim 9 further comprising:

an environment controller connected to the second RF switch, the long-distance simulator, and the RF receiver; and a feedback path operatively connected between the RF transmitter controller and the environment controller.

12. The system of claim 9, wherein the long-distance simulator comprises:

an RF-optical modulator connected to the second optical switch;

a first optical switch connected to the RF-optical modulator;

at least two fiber-optic cables connected to the first optical switch;

a second optical switch connected to the at least two fiber-optic cables; and an RF-optical demodulator connected to the RF receiver.

13. The system of claim 8 further comprising a long-distance simulator connected between the RF transmitter and the first RF switch.

14. The system of claim 13, wherein the long-distance simulator comprises:

an RF-optical modulator connected to the RF transmitter;

a first optical switch connected to the RF-optical modulator;

at least two fiber-optic cables connected to the first optical switch;

a second optical switch connected to the at least two fiber-optic cables; and an RF-optical demodulator connected to the second optical switch.

15. The system of claim 1, wherein the phase-matched connectors are nested cosine wires.

16. A system comprising:

a variable attenuator connected to a first branch of a power divider/combiner;

a first RF lens pair connected to the variable attenuator; and a second RF lens pair connected to a second branch of the power divider/combiner wherein the first RF lens pair and the second RF lens pair each comprise:

a first RF lens having at least two first RF lens array ports and at least one first RF lens beam port, and a second RF lens having at least two second RF lens array ports and at least one second RF lens beam port, wherein at least two of the second RF lens array ports are connected to at least two of the first RF lens array ports by phase-matched connectors.

17. The system of claim 16 further comprising:

an RF transmitter connected to a common port of the power divider/combiner;

an RF transmitter controller connected to the RF transmitter;

a first RF receiver connected to the first RF lens pair;

a first RF receiver controller connected to the first RF receiver;

a second RF receiver connected to the second RF lens pair; and a second RF receiver controller connected to the second RF receiver.

18. The system of claim 16 further comprising:

an RF receiver connected to a common port of the power divider/combiner;

an RF receiver controller connected to the RF receiver;

a first RF transmitter connected to the first RF lens pair;

a first RF transmitter controller connected to the first RF transmitter;

a second RF transmitter connected to the second RF lens pair;

a second RF transmitter controller connected to the second RF transmitter;

a feedback path operatively connected between the RF receiver controller and the first RF transmitter controller; and a feedback path operatively connected between the RF receiver controller and the second RF transmitter controller.

* * * * *